US007713487B1

(12) United States Patent
Locklear et al.

(10) Patent No.: US 7,713,487 B1
(45) Date of Patent: May 11, 2010

(54) PIPETTE GUIDE AND METHOD

(75) Inventors: Chad Locklear, Cary, NC (US); Joseph J. Malasky, IV, Arden, NC (US); Edward L. Peart, Arden, NC (US); Michael Johnson, Pleasant Garden, NC (US)

(73) Assignee: Stovall Life Science, Inc., Greensboro, NC (US)

( * ) Notice: Subject to any disclaimer, the term of this patent is extended or adjusted under 35 U.S.C. 154(b) by 1224 days.

(21) Appl. No.: 10/890,760

(22) Filed: Jul. 14, 2004

(51) Int. Cl.
*B01L 9/00* (2006.01)

(52) U.S. Cl. ..... 422/104; 422/99; 422/100; 422/102; 73/864.01

(58) Field of Classification Search ..... 422/99, 422/100, 102, 104; 73/864.01, 864.14, 864.17, 73/864.24

See application file for complete search history.

(56) References Cited

U.S. PATENT DOCUMENTS 3,168,124 A * 2/1965 Lenkey ..... 141/284
3,687,175 A * 8/1972 Babey ..... 141/59
3,843,053 A * 10/1974 Thoden ..... 239/11
4,004,548 A * 1/1977 Smola et al. ..... 118/58
4,265,855 A * 5/1981 Mandle et al. ..... 422/65
4,827,780 A * 5/1989 Sarrine et al. ..... 73/864.21
4,919,894 A * 4/1990 Daniel ..... 422/104
5,262,128 A * 11/1993 Leighton et al. ..... 422/100
5,290,521 A * 3/1994 DeStefano, Jr. ..... 422/99
5,415,060 A * 5/1995 DeStefano, Jr. ..... 74/540
5,842,582 A * 12/1998 DeStefano, Jr. ..... 211/60.1
6,135,406 A * 10/2000 DeStefano, Jr. ..... 248/309.1
6,231,813 B1 * 5/2001 Ally et al. ..... 422/100
6,245,826 B1 * 6/2001 Wilson et al. ..... 521/174
6,921,513 B2 * 7/2005 Schubert et al. ..... 422/100
7,597,854 B1 * 10/2009 Reynolds ..... 422/104

OTHER PUBLICATIONS

One page advertisement for Hamilton SoftGrip Pipettes; undated.

* cited by examiner

*Primary Examiner*—Jill Warden
*Assistant Examiner*—Dwayne K Handy

(57) ABSTRACT

A guide for use with a manual pipette used in loading well plates is provided which insures the accuracy and efficiency of reservoir loading. The pipette guide is used in combination with a conventional well plate generally having 96-384 reservoirs. The guide allows for more exact delivery of liquid reagents to selected reservoirs without concern for missing or duplicating particular reservoirs during loading. The pipette guide is releasably locked onto the well plate and a slide outlines a specific row of reservoirs. In addition a reservoir isolator allows delivery to a single selected reservoir and protects against cross-contamination. Adjustable rods with notches therealong allow the slide and isolator to be precisely moved and indexed as desired.

14 Claims, 6 Drawing Sheets

PIPETTE GUIDE AND METHOD

FIELD OF THE INVENTION

The invention herein pertains to laboratory procedures, particularly procedures involving the transfer of chemical reagents using a single or multichannel manual or electronic pipette.

DESCRIPTION OF THE PRIOR ART AND OBJECTIVES OF THE INVENTION

In recent years costs for laboratory testing and analysis has dramatically risen due in part to the increased salaries of qualified laboratory employees and technicians. In addition, the cost of materials used has also risen including the cost for supplies, such as well plates, chemical reagents and other resources. Manual loading by pipettes of chemical reagents into well plates having either 96 or 384 reservoirs is commonplace. Well plates exhibiting more numerous reservoirs are usually robotically loaded. With few exceptions laboratories commonly utilize manual pipette loading of well plates having 384 or fewer reservoirs. Such well plate loading is often routine and monotonous causing laboratory technicians carrying out such testing and analysis to become inattentive, easily distracted or confused as to the particular reservoir to be loaded next. Sometimes duplication and omissions occur. At other times cross contamination occurs from one reservoir to another due to improper techniques employed in pipette loading.

Once it has been determined that a single reservoir has been improperly loaded or overloaded in a well plate, the error may require the technician to discard the current well plate and start anew. Such errors can be expensive, time consuming and libelous, depending on the particulars of the test or analysis conducted.

Thus with the problems and disadvantages of current well plate loading techniques using manual pipettes, methods and equipment the present invention was conceived and one of its objectives is to ensure faster, more accurate reservoir loading by pipette using manual procedures.

It is another objective of the present invention to provide a pipette guide and method which limits the number of well plate reservoirs exposed at any particular time and helps prevent cross contamination.

It is yet another objective of the present invention to provide a pipette guide which can be locked onto a standard skirted or non-skirted well plate during loading.

It is still another objective of the present invention to provide a pipette guide which includes a movable slotted slide for outlining a single row of reservoirs for pipette loading.

It is yet another objective of the present invention to provide a reservoir isolator which will allow only one specific reservoir in a row to be loaded while shielding immediately adjacent reservoirs from contamination.

It is a further objective of the present invention to provide a method of well plate loading using a manual pipette which will allow greater accuracy and eliminate errors, retesting and analysis.

It is also an objective of the present invention to provide a pipette guide which can be easily locked onto a well plate for loading and readily removed for placement on another well plate as needed.

Various other objectives and advantages of the present invention will become apparent to those skilled in the art as a more detailed description is set forth below.

SUMMARY OF THE INVENTION

The aforesaid and other objectives are realized by providing a pipette guide and method, of use which ensure more accurate and efficient reagent delivery to selected well plate reservoirs. The pipette guide includes a cover having a movable slide mounted thereon. The slide is slotted to outline a single row of reservoirs when used with a conventional well plate. A window formed in the cover allows the slide to span the window, outlining selected rows of reservoirs as desired. A slide rod is affixed to the slide from which a single reservoir isolator is suspended. The reservoir isolator is coincidentally aligned with the slide slot whereby a specific reservoir in the row outlined is available for reagent delivery from the pipette.

In use, the pipette guide is secured to the well plate by a manual lock beneath the cover. The lock frictionally engages the side of the well plate to hold it in place during use. Once the well plate has been fully loaded, the lock can be released and the pipette guide placed on another well plate for subsequent loading.

A side rod affixed along one edge of the pipette guide cover includes notches for engagement by a resilient clip. As the slide is movably joined to the side rod, the clip will provide slide indexing along the cover as each successive notch is engaged. If the wrong series of notches is selected for a particular well plate the incorrect movement of the slide will be readily apparent to the user. The rod can be loosened and rotated to reveal a second series of notches. Each set of notches on the side rod corresponds to the number of reservoir rows of the well plate. In addition, a slide rod likewise includes two (2) sets of notches which correspond to the number of reservoirs in a particular row as outlined by the slide slot.

Thus, by using the pipette guide in the reservoir loading process less likelihood of an error exists due to the outlining and isolation of particular selected reservoirs.

DETAILED DESCRIPTION OF THE PREFERRED EMBODIMENT AND OPERATION OF THE INVENTION

Figure 1:
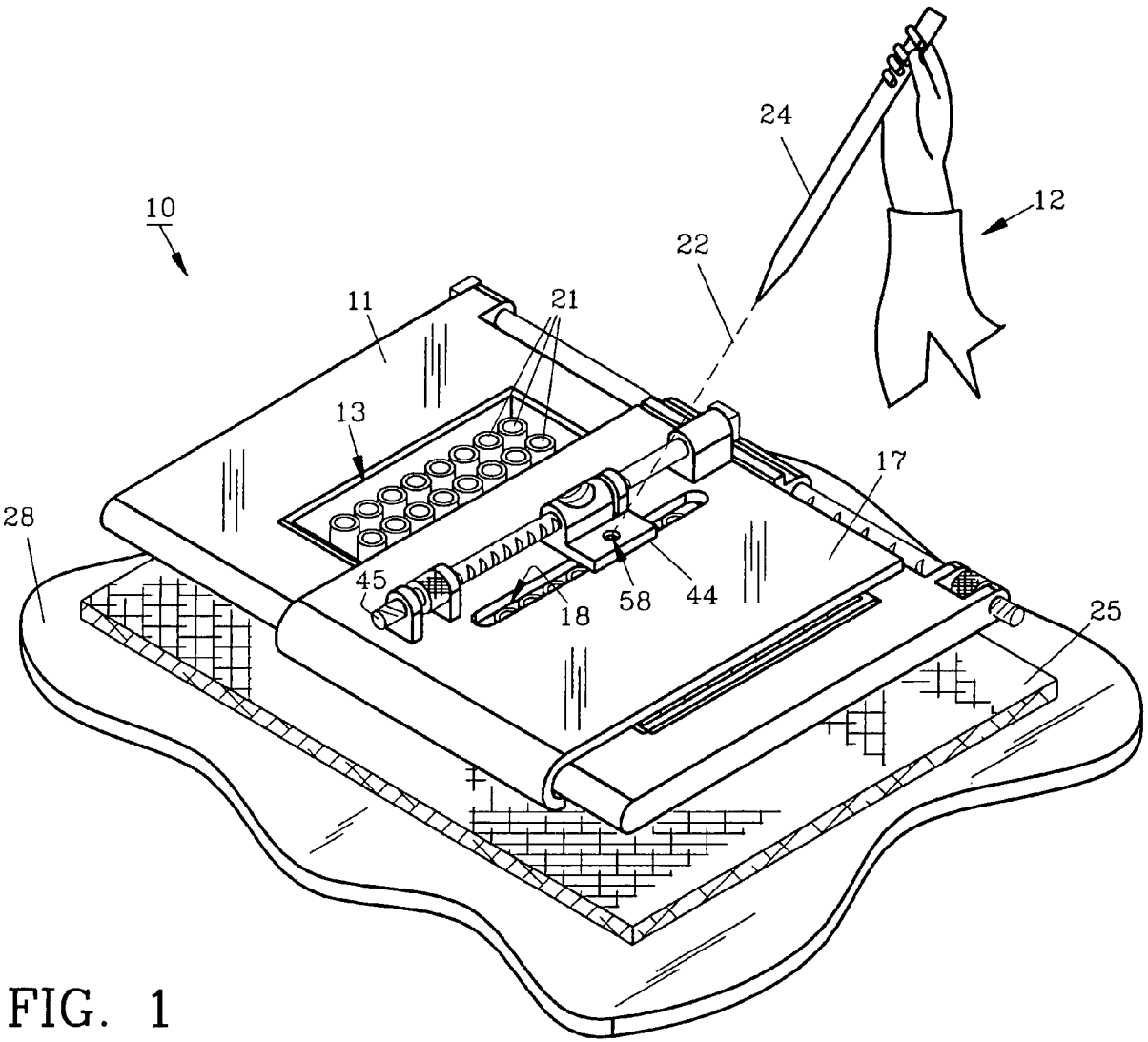
FIG. 1 shows a perspective view of the invention as positioned on a fragmented laboratory counter.

For a better understanding of the invention and its operation, turning now to the drawings, FIG. 1 shows preferred pipette guide 10 attached to conventional well plate 20 (seen also in FIG. 2) which comprises ninety-six (96) reservoirs 21 shown therein. Pipette guide 10 can also be affixed to other conventional well plates having for example, 384 reservoirs (not shown) as desired.

In use well plate 20 is placed on conventional non-slip rubber or polymeric mat 25 supported on a table or laboratory counter 28. While mat 25 is not absolutely necessary, it prevents well plate 20 from any advertent movement as reagent 22 is manually loaded into reservoirs 21 of well plate 20 through standard pipette 24. Reagent 22 can be any number of conventional laboratory chemicals, solutions, solvents and the like as are commonly employed during laboratory testing and analysis.

When loading well plate 20 as in various laboratory procedures, user 12 (as illustrated in fragmented fashion in FIG. 1) may become tired, distracted or interrupted during this tedious process. When fatigue occurs, a particular reservoir 21 may be inadvertently omitted or duplicate loading may occur. When using a well plate having a high density of reservoirs, problems significantly increase if the well openings are small and more difficult to see. Pipette guide 10 thereby greatly facilitates the accurate loading of reservoirs 21 and increases the efficiency and accuracy of user 12.

Figure 2:
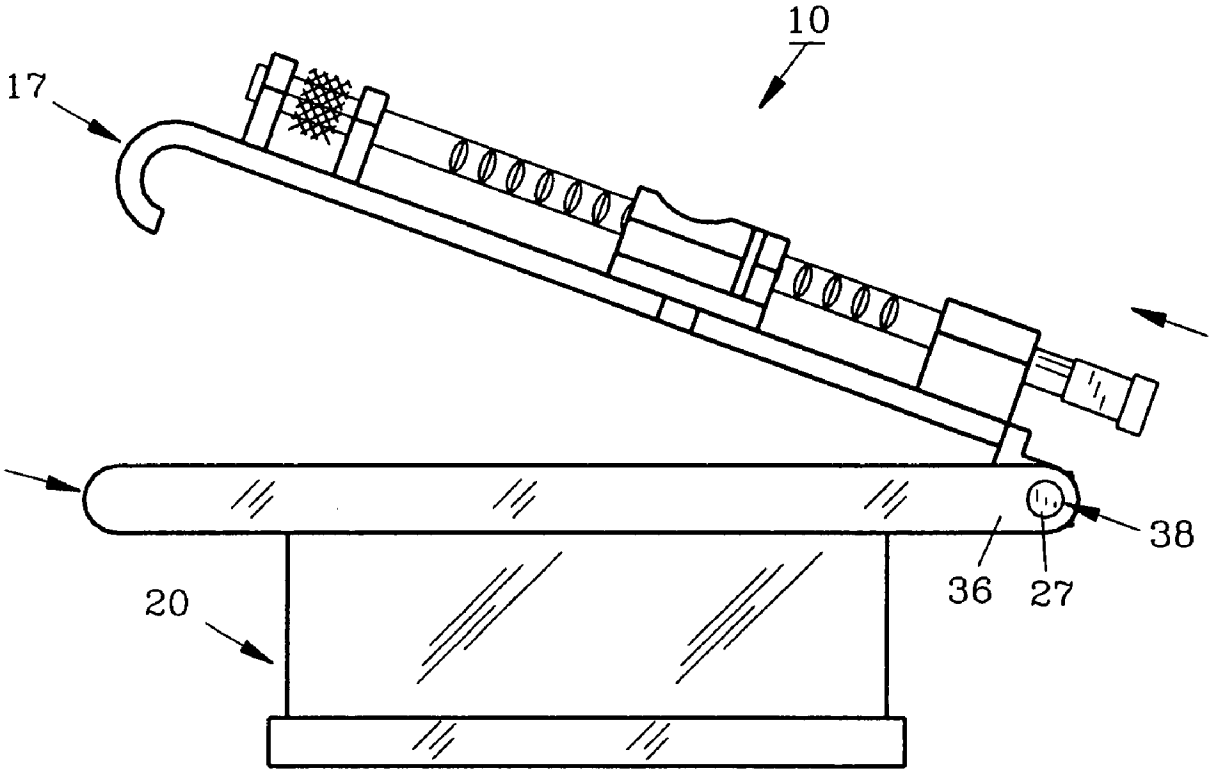
FIG. 2 illustrates an end view of the pipette guide with the slide raised approximately 30° from the cover.

In FIG. 2, pipette guide 10 is shown with cover 11 atop well plate 20. Cover 11 surrounds the top and edges of well plate 20 and is locked thereon for convenience purposes. Pipette guide 10 is formed from a conventional plastic, preferably polycarbonate although other standard materials may be used. Cover 11 defines large central window 13 which exposes all reservoirs 21 within well plate 20.

Figure 4:
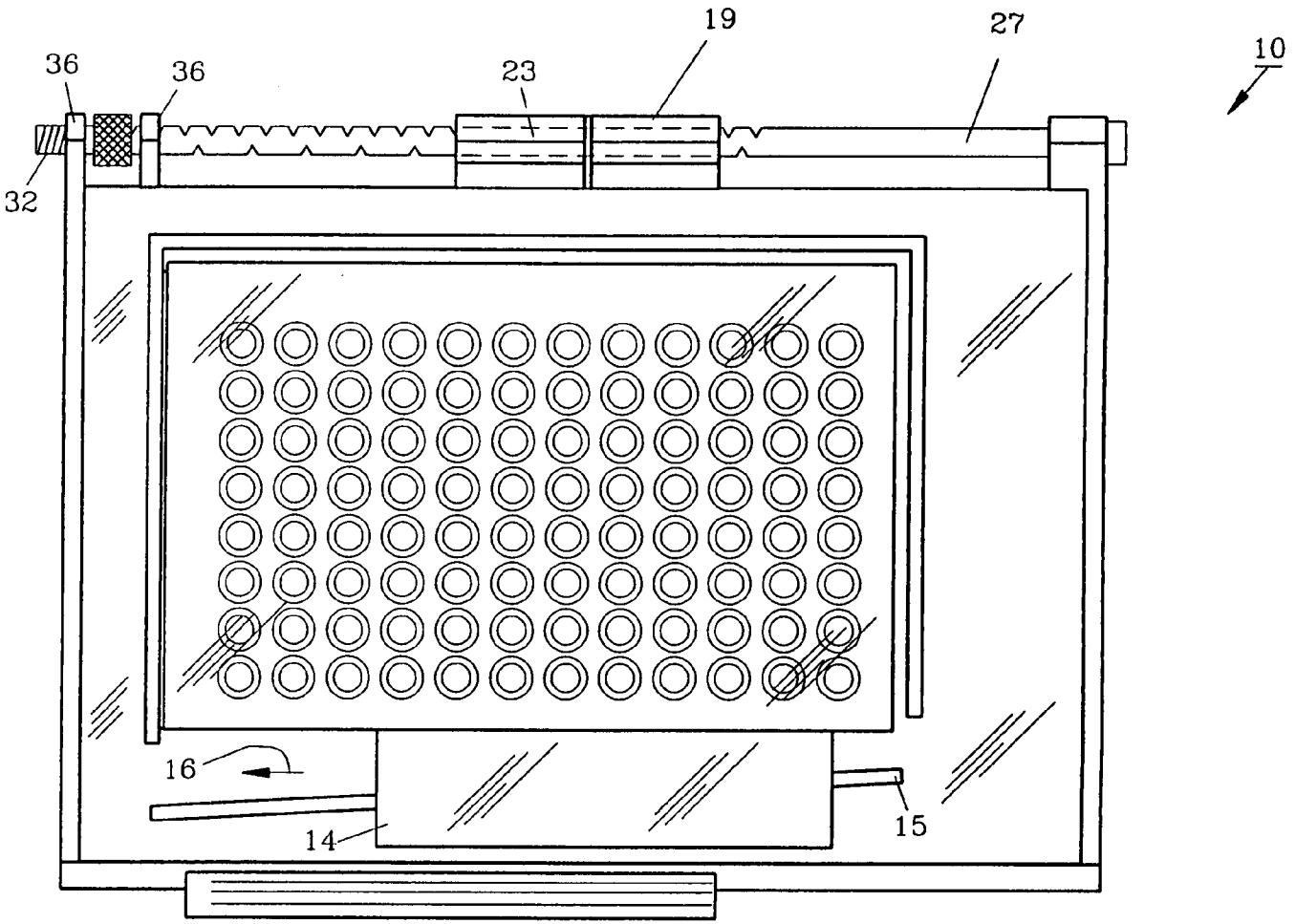
FIG. 4 demonstrates a bottom view of the pipette guide as seen in FIG. 3.

Pipette guide 10 is releasably attached to well plate 20 as shown in FIG. 4 by lock 14 which is slidable on rail 15 and is mounted at an approximate 7½ degree angle to the longitudinal axis (not shown) of cover 11. Thus, as lock 14 is maneuvered on rail 15, it will frictionally engage well plate 20 thus securing pipette guide 10 to well plate 20 as needed. To remove pipette guide 10 from well plate 20, lock 14 is simply slid along rail 15 from well plate 20 as shown by arrow 16 in FIG. 4.

Figure 3:
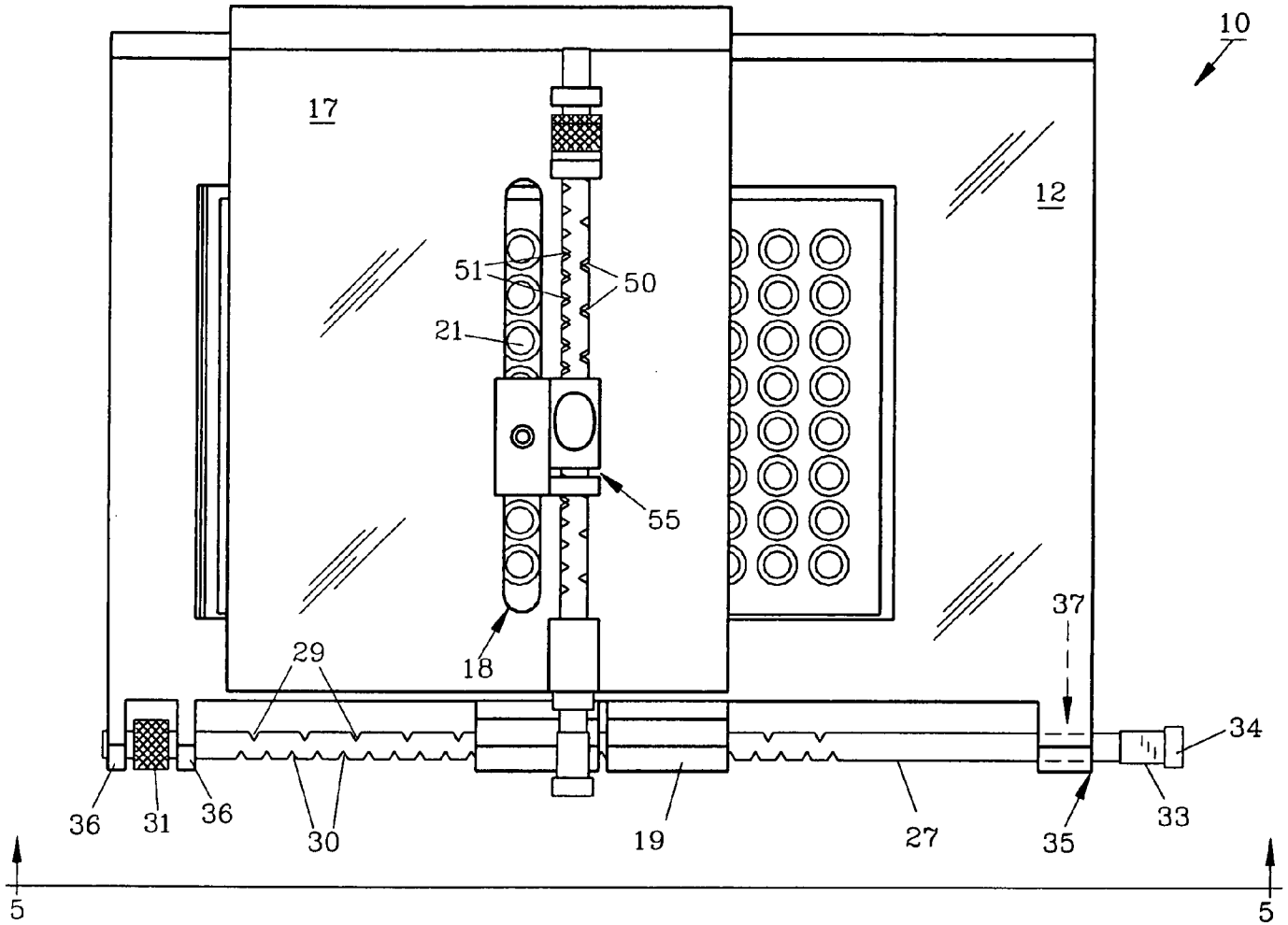
FIG. 3 depicts a top view of the pipette guide with the side rod and slide rod somewhat withdrawn.

As earlier explained, pipette guide 10 is employed for more efficient and accurate pipette loading by user 12. As shown in FIGS. 1 and 3, once pipette guide 10 is locked to well plate 20 and placed on mat 25, slide 17 is then manipulated whereby slot 18 will expose a selected reservoir row (one row of the twelve rows of a typical ninety-six (96) reservoir well plate). Slot 18 extends laterally and exposes all eight (8) reservoirs 21 of a particular row of well plate 20. Slide 17 is configured to expose only one row of reservoirs 21 while shielding and concealing adjacent rows along each side of the selected exposed row to prevent cross-contamination. As seen in FIG. 1 reagent can therefore be placed only within the exposed row of reservoirs 21 without moving slide 17. Slide 17 is pivotally attached to cover 11 along the side thereof as shown in FIG. 2. Slide 17 includes dependent flange 19 shown in FIGS. 4 and 5 and includes channel 23 for receiving side rod 27. Thus, slide 17 moves along side rod 27 of cover 11 and exposes (through slot 18) only one row of reservoirs 21 at a time in well plate 20. Side rod 27 is preferably formed of stainless steel and includes a series of opposing notches 29, 30 therealong, as seen in FIG. 3. Twelve (12) notches 29 correspond with the twelve (12) rows of reservoirs in well plate 20. Thirty-six (36) notches 30 in the other side of side rod 27 correspond with the 36 rows of reservoirs in a standard 384 reservoir well plate (not seen). Thus, in using pipette guide 10, user 12 will first select the particular well plate desired, whether the 96 or 384 reservoir type, and will then position side rod 27 for a 96 reservoir well plate or will rotate side rod 27, 180° for a 384 reservoir well plate to allow notches 30 to be in an active position. The notches selected in side rod 27 are chosen by releasing lock nut 31 from threads 32 (FIG. 4) by turning lock nut 31 and when sufficiently loosened, square shoulders 33 proximate head 34 are withdrawn from cover rod lug 35 seen in FIG. 3. Next, side rod 27 is manually rotated 180°. Lock nut 31 is then rotated in the opposite direction to drive or tighten threads 32 therein, causing shoulders 33 to once again enter cover rod lug 35, having a square cross-sectional channel 37, thereby preventing rotation of side rod 27. As would be understood, additional rotation of lock nut 31 tightens side rod 27 as threads 32 move through cover rod lugs 36 (FIG. 3) which sandwich lock nut 31 therebetween. Cover rod lugs 36 include openings 38 (FIG. 5) to allow side rod 27 to pass therethrough as lock nut 31 is rotated.

Well plates are manufactured with consistent center-to-center dimensions but variations in the outer well plate dimensions are usual. Thus, lock nut 31 can be manually rotated for a fine adjustment to exactly center index slide 17 on the initial row of reservoirs.

Figure 5:
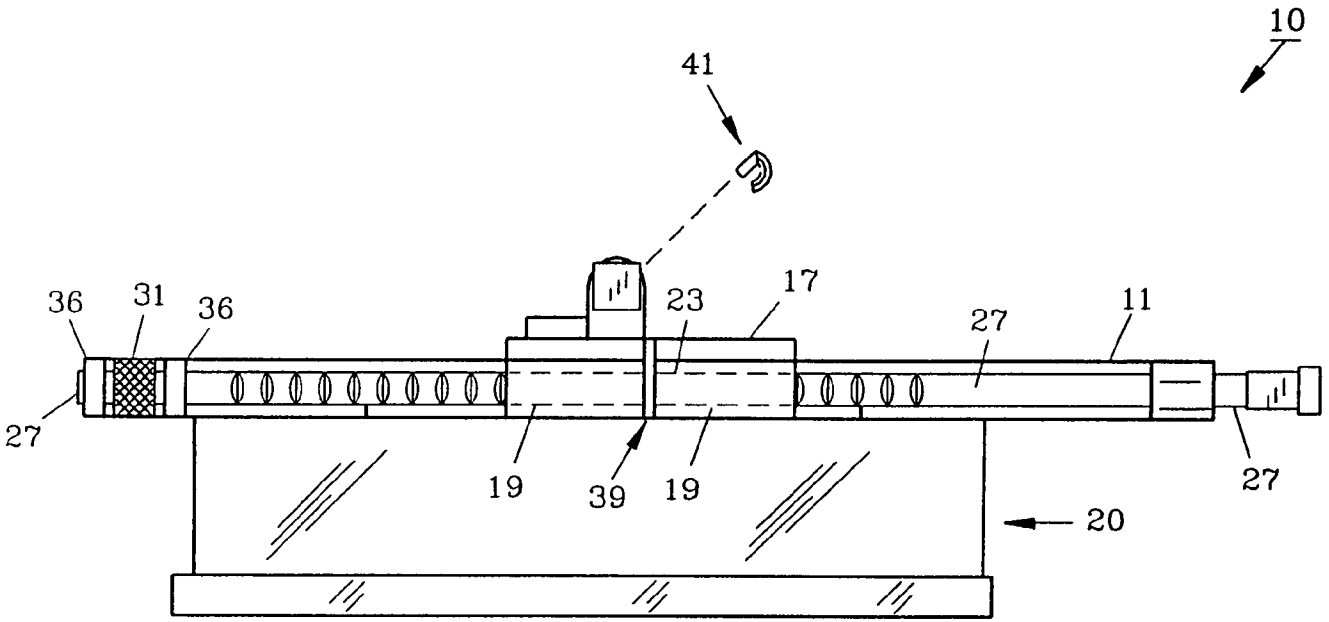
FIG. 5 features a side view along lines 5-5 of FIG. 3 with the reservoir isolator clip exploded therefrom.
Figure 7:
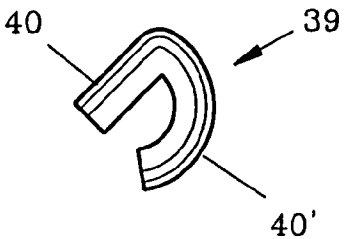
FIG. 7 illustrates the c-shaped clip as removed from the slide.

To precisely index slide 17 as it moves from row to row of reservoirs 21 along well plate 20, flange 19 includes c-shaped metal clip 39 as shown in FIG. 5. C-shaped clip 39 seen enlarged in FIG. 7 has a flattened upper portion 40 for engagement with notches 29 or 30 in side rod 27 and a lower rounded portion 40' which surrounds or engages side rod 27 to maintain clip 39 thereon. When a row of reservoirs 21 have been loaded by pipette 24 as shown in FIG. 1, c-shaped clip 39 allows slide 17 to be manually moved to the next reservoir row desired and in conjunction with notches 29 allows slide 17 to thereby index the correct distance for alignment of slot 18 with the next row of reservoirs 21. Thus, clip 39 assists user 12 in fast, accurate access to a desired reservoir row in well plate 20.

Figure 6:
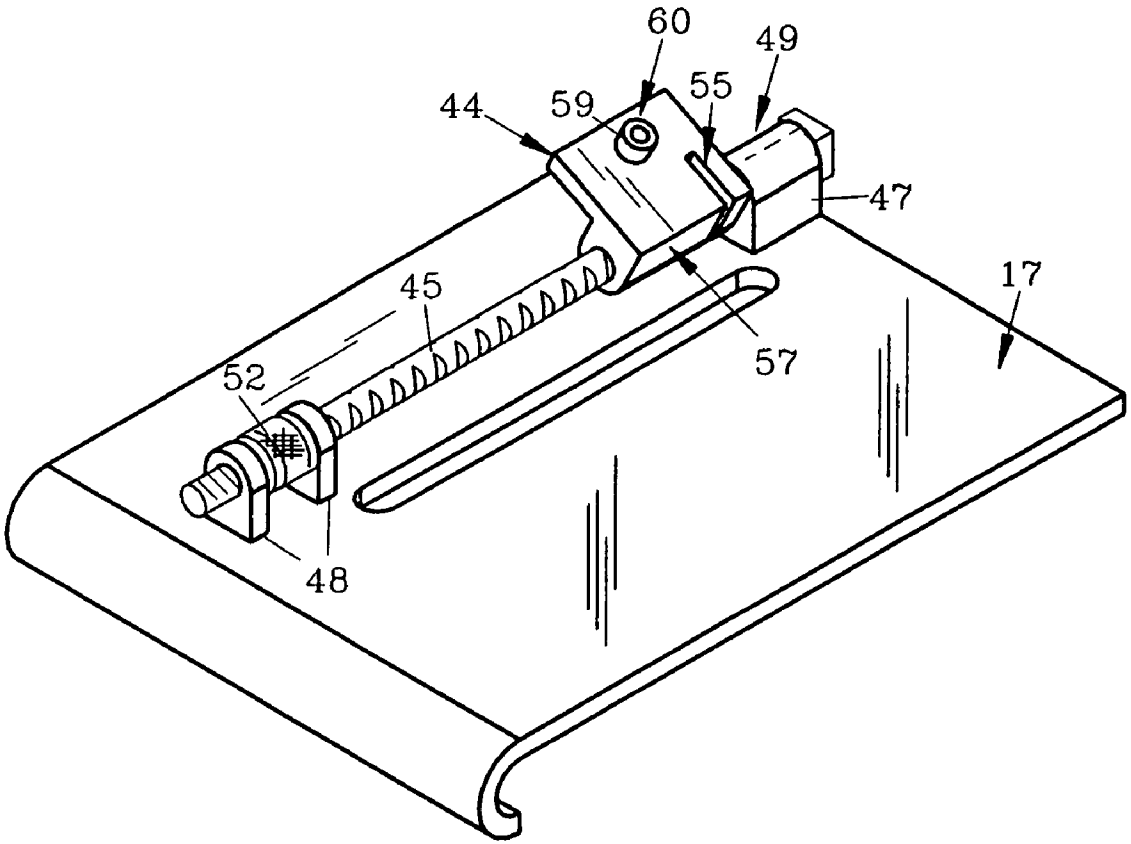
FIG. 6 shows the slide removed from the cover and the reservoir isolator rotated about 100° to expose the reservoirs below.

When only one specific reservoir 21 is to be loaded by pipette, reservoir isolator 44 as shown in FIGS. 1 and 6 is used. Isolator 44 is slidably mounted on lateral slide rod 45 as seen in FIG. 6 through channel 57. Lateral slide rod 45 is similar to side rod 27 and is mounted on slide 17 using slide lugs 47 and 48 (FIG. 6). Rectangular channel 49 of slide lug 47 prevents rod 45 from inadvertent turning and allows alignment for employing either notches 50 or 51 seen in FIG. 3 as desired as earlier explained. Slide lugs 48 likewise receive slide rod 45 and lock nut 52 is used to tighten threaded lateral slide rod 45 therein in a selected position. C-shaped clip 41 as shown in FIG. 5 is inserted into isolator slot 55 as seen in FIG. 3 for selected engagement with notches 50 or 51 to allow reservoir isolator 44 to precisely move or index from one reservoir to another in an accurate, precise manner.

As further seen in FIGS. 1 and 6 reservoir isolator 44 includes port 58, ridge 59 and lower end 60 of ridge 59. Lock nut 52 can be manually rotated to precisely center port 58 over the initial reservoir 21 to insure accurate, subsequent movement of reservoir isolator 44. Ridge 59 surrounds the bottom of port 58 to thus decrease the distance from reservoir isolator 44 to a particular reservoir 21 as lower end 60 of ridge 59 is substantially flush with the bottom of slide 17 while in coincidental alignment therewith. By decreasing this distance, greater accuracy in pipetting is obtained and the chances of cross contamination with adjacent reservoirs 21 are diminished.

In the preferred method of use of pipette guide 10, a desired well plate 20 having either 96 or 384 reservoirs 21 is selected. Pipette guide 10 is then placed atop the well plate such as well plate 20 shown in FIG. 1 and lock 14 is then urged along rail 15 into engagement with well plate 20 (FIG. 4). Next, well plate 20 with pipette guide 10 is placed on a suitable friction producing surface such as rubber mat 25 atop a laboratory counter 28 or the like (FIG. 1). Slide 17 is manually moved and positioned whereby slot 18 exposes a selected row of reservoirs 21 and by using conventional pipette 24, or a multichannel pipette (not seen), reservoirs 21 can then be filled. If all reservoirs 21 in the row are to be filled, pipette 24 is used to load all reservoirs 21. However, if only one or a few selected reservoirs are to be loaded than reservoir isolator 44 is manually indexed along lateral slide rod 45 to a selected reservoir 21. After loading, reservoir isolator 44 can be moved to another reservoir 21 in the same row as desired or can be pivoted on slide rod 45 to an upward or dormant position as shown in FIG. 6. Slide 17 is then indexed along side rod 27 to the next desired row of reservoirs 21 and the loading process repeated as needed.

Once the desired number of selected reservoirs and rows are so loaded, lock 14 is then loosened and pipette guide 10 removed from well plate 20 for further processing of the reservoir contents. Pipette guide 10 can then be placed on another well plate 20 and the process repeated as needed.

The illustrations and examples provided herein are for explanatory purposes and are not intended to limit the scope of the appended claims.

We claim:

1. A guide for a manual pipette in combination with a well plate for, precise reagent delivery to a particular well plate reservoir, said pipette guide mounted atop said well plate, said well plate comprising:

a) a number of individual rows and columns of reservoirs for receiving reagents, said pipette guide comprising:

a) a cover, said cover defining a window to expose said reservoir rows and columns;

b) a slide, said slide having a top and a bottom, side slide moveably affixed to said cover, said slide defining a slot, said slot exposing only one row of said reservoirs within said window while covering other of said reservoirs rows within said window;

c) a reservoir isolator, said reservoir isolator mounted to move along said row of reservoirs exposed by said slide slot to a particular reservoir exposed in said row; and d) a rotatable slide rod, a lug, said lug attached to said slide, said slide rod positioned through said lug proximate said slot, said reservoir isolator mounted on said slide rod, said reservoir isolator having a width greater than the diameter of said particular exposed reservoir, said reservoir isolator defining a port, said port positioned over said particular exposed reservoir, whereby a pipette can deliver a reagent through said port in to the particular exposed reservoir, while said reservoir isolator shields reservoirs adjacent to said particular exposed reservoir in said row of reservoirs exposed by said slot.

2. The combination of claim 1 wherein said reservoir isolator further comprises a ridge, said ridge positioned on said reservoir isolator in communication with said port, said ridge defining a lower end, said lower end positioned in said slot flush with said bottom of said slide.

3. The combination of claim 2 wherein said reservoir isolator is pivotable around said slide rod.

4. The combination of claim 1 wherein said slide rod defines a plurality of threads, a lock nut, said lock nut positioned on said threads, said lock nut tightenable on said slide rod threads to prevent rotation of said slide rod.

5. The combination of claim 1 wherein said lug defines a rectangular channel, said slide rod positioned through said rectangular channel, said rectangular channel to prevent inadvertent rotation of said slide rod.

6. The combination of claim 1 wherein said cover comprises a lock, a rail, said lock slideable along said rail, said lock for frictionally engaging said well plate to secure said cover to said well plate.

7. The combination of claim 1 wherein said slide defines an arcuate edge, said arcuate edge engaging said cover.

8. The combination of claim 7 further comprising a side rod, said side rod opposingly positioned to said arcuate edge, said side rod affixed to said cover, said side rod defines a first series of notches, said first series of notches corresponding to the number of rows of said well plate.

9. The combination of claim 8 wherein said side rod defines a second series of notches, said second series of notches corresponding to the number of well plate reservoirs, said second series of notches numerically different from said first series of notches, said second series of notches opposingly positioned on said side rod from said first series of notches.

10. A manual pipette guide for use with a well plate having a plurality of reservoirs comprising: a cover, said cover defining a window, a slideable lock, a rail, said lock positioned on and slideable along said rail, said rail affixed to said cover, a side rod, said side rod attached to said cover along one side, a slide, a flange, said flange affixed to said slide, said side rod engaging said flange, said slide defining an arcuate edge, said arcuate edge engaging said cover along the side opposite said side rod, a slide rod, said slide rod mounted on said slide, said slide rod normal to said side rod, a reservoir isolator, said reservoir isolator movably positioned on said slide rod, said reservoir isolator defining a port, said port allowing a guide for a pipette to deliver a reagent to a specific well plate reservoir, said lock for attaching said cover to the well plate.

11. The pipette guide of claim 10 further comprising a lug, said lug defining a rectangular channel, said slide rod mounted in said rectangular channel.

12. The pipette guide of claim 10 further comprising a locking nut, said slide rod defining threads, said locking nut positioned on said slide rod threads.

13. The pipette guide of claim 10 wherein said side rod defines a first series of notches said series of notches corresponding to well plate rows.

14. The pipette guide of claim 13 further defining a second series of notches on said side rod, said second series of notches numerically different from said first series of notches, said second series of notches opposingly positioned on said side rod from said first series of notches.

* * * * *